United States Patent [19]

Sweeney et al.

[11] 4,356,001

[45] Oct. 26, 1982

[54] METHOD OF EXTENDING HYDROCARBON FUELS INCLUDING GASOLINES AND FUELS HEAVIER THAN GASOLINE

[75] Inventors: William M. Sweeney, Wappingers Falls; Sheldon Herbstman, Spring Valley, both of N.Y.

[73] Assignee: Texaco Inc., White Plains, N.Y.

[21] Appl. No.: 155,351

[22] Filed: Jun. 2, 1980

[51] Int. Cl.[3] ..... C10L 1/02

[52] U.S. Cl. ..... 44/56; 44/53; 44/57

[58] Field of Search ..... 44/53, 56, 77, 57; 568/697

[56] References Cited

U.S. PATENT DOCUMENTS

| | | | |
|---|---|---|---|
| 2,480,940 | 9/1949 | Leum et al. | 568/697 |
| 3,697,240 | 10/1972 | Hori et al. | 44/53 |
| 3,912,463 | 10/1975 | Kozlowski et al. | 568/697 |

*Primary Examiner*—Charles F. Warren
*Assistant Examiner*—Y. Harris-Smith
*Attorney, Agent, or Firm*—Carl G. Ries; Robert A. Kulason; Carl G. Seutter

[57] ABSTRACT

Hydrocarbon fuels including gasoline and fuels heavier than gasoline may be extended by addition thereto of ether-alcohol extenders, soluble in the hydrocarbon fuel, prepared by etherifying an oxy-alcohol mixture. The product is a single-phase mixture which possesses improved water tolerance.

15 Claims, No Drawings

METHOD OF EXTENDING HYDROCARBON FUELS INCLUDING GASOLINES AND FUELS HEAVIER THAN GASOLINE

FIELD OF THE INVENTION

This invention relates to a novel method of extending liquid hydrocarbon fuels including gasoline and fuels heavier than gasoline such as middle distillate liquid hydrocarbons typified by diesel fuel. More particularly it relates to the extension of a diesel fuel with mixtures of ethers and alcohols derived from oxo-mixtures.

BACKGROUND OF THE INVENTION

As is well known to those skilled in the art, gasoline and hydrocarbon fuels heavier than gasoline including middle distillate hydrocarbon fuels, typified by diesel oils or fuel oils may become in short supply. Attempts to extend these fuels by addition thereto of methanol or ethanol for example, have not heretofore been satisfactory because these fuels (such as diesel oil or No. 2 furnace oil) will only dissolve eg methanol to the extent of a percent or two. Addition of these alcohols to gasoline provides a fuel with very low water tolerance.

It is an object of this invention to provide a method of extending gasoline or hydrocarbon fuels heavier than gasoline including middle distillate fuels such as diesel oil. Other objects will be apparent to those skilled in the art.

STATEMENT OF THE INVENTION

In accordance with certain of its aspects, this invention is directed to a method of extending a liquid hydrocarbon fuel which comprises mixing (i) a liquid hydrocarbon fuel and (ii) an ether-alcohol mixture formed by etherifying an oxo-alcohol mixture with a C-4 or C-5 iso-olefin, thereby forming a single phase extended liquid hydrocarbon fuel characterized by improved water tolerance; and recovering said single phase extended liquid hydrocarbon fuel characterized by improved water tolerance.

In accordance with certain of its other aspects, this invention is directed to a novel single-phase extended liquid hydrocarbon fuel composition characterized by improved water tolerance which comprises (i) a liquid hydrocarbon fuel and (iii) an ether-alcohol mixture formed by etherifying an oxo-alcohol mixture with a C-4 or C-5 iso-olefin.

DESCRIPTION OF THE INVENTION

The gasolines which may be extended by the process of this invention include straight run gasoline, alkylate gasoline, FCCU gasoline etc. typified by a blended gasoline having an ibp of 90° F., an ep of 420° F., a RON (clear) of 92 and a MON of 82.

The hydrocarbon fuels heavier than gasoline which may be extended by the process of this invention include those which typically have an initial boiling point (ibp) above about 320° F. Typically such fractions may be identified as kerosene, diesel oil or furnace oil, fuel oil, light gas oil, heavy gas oil, light cycle gas oil, heavy cycle gas oil, vacuum gas oil etc. These fractions which include middle distillates commonly have an initial boiling point above about 340° F.

In the case of a kerosene, the fuel may be characterized by an ibp of 300° F.–400° F., say 350° F., an ep of 500° F.–600° F., say 550° F., and an API gravity of 30–70, say 50.

In the case of a diesel oil or furnace oil, the fuel may be characterized by an ibp of 325° F.–425° F., say 350° F., an ep of 575° F.–690° F., say 610° F., and an API gravity of 25–50, say 40.

In the case of a vacuum gas oil, the fuel may be characterized by an ibp of 600° F.–700° F., say 650° F., an ep of 900° F.–1100° F., say 1050° F., and an API gravity of 10–35, say 25.

In the case of a light cycle gas oil, it may be characterized by an ibp of 300° F.–400° F., say 350° F., an ep of 575° F.–670° F., say 610° F., and an API gravity of 20–40, say 30.

In the case of a heavy cycle gas oil, it may be characterized by an ibp of 500° F.–550° F., say 525° F., an ep of 600° F.–700° F., say 680° F., and an API gravity of 20–35, say 25.

In the case of a residual fuel oil, it may be characterized by an API gravity of 5–25, say 20.

Illustrative fuels which may be treated by the process of this invention include (i) a gasoline having an ibp of 90° F., an ep of 420° F., a RON (clear) of 88–94, and an MON of 80–84; (ii) a diesel fuel having an ibp of 350° F., an ep of 650° F., an API gravity of 37, and a cetane number of 44; (iii) a No. 2 furnace oil having an ibp of 376° F., an ep of 623° F., and an API gravity of 35; (iv) a vacuum gas oil having an ibp of 680° F., and ep of 1050° F., and an API gravity of 25.

Gasolines which are extended by the use of methanol and ethanol are found to possess low tolerance to water i.e. in the presence of water, they form two phases.

The hydrocarbon fuels heavier than gasoline are characterized by the fact that methanol and ethanol (in the presence of very small amounts of water eg 0.1 w %) are substantially insoluble therein—typically less than 10 w % and in some cases less than 1–2 w %. It is a feature of this invention that the advantages sought by use of methanol and ethanol as fuel extenders can be obtained by converting oxy-alcohol (also called oxo-alcohol) mixtures to ether derivatives thereof which are characterized by substantially complete miscibility with the fuels, even in the presence of water. The derivatives which may be readily prepared are advantageous because (i) they are miscible with gasoline and hydrocarbon fuels heavier than gasoline and (ii) they have higher molecular weight and thus generally yield a product mix having desirably higher initial boiling point.

The compositions which may be used to prepare the extenders of this invention may be derived from oxygenated products produced by reaction of carbon monoxide and hydrogen in reactions commonly referred to as Fischer-Tropsch reactions. This process which operates at low pressures, typically atmospheric, and moderate temperature, typically 150° C.–650° C., may produce a product mix containing oxygenated products. Such products, may contain 40%–80% alcohols, 5%–10% aldehydes, 2%–15% ketones, and 5%–30% acids. The alcohol-ketone-aldehyde portion, called non-acidic oxygenates, is separated from the acidic components which latter are discarded. The non-acidic oxygenates are then hydrogenated to yield a useful mixture of alcohols which is marketed as oxyalcohol, (also called oxo-alcohol) SASOL alcohol, synthol, etc.

Typical products may be as follows: (all in parts by weight)

| Alcohol | A | B |
|---|---|---|
| methanol | 0.3 | 1.3 |
| ethanol | 36.9 | 52.4 |
| n-propanol | 8.7 | 12.1 |
| i-propanol | 0.8 | 2.8 |
| n-butanol | 4.0 | 4.0 |
| C-5 alcohol | | 1.9 |
| C-6 alcohol and higher | 1.2 | 1.8 |

A is an illustrative alcohol from a Hydrocol fluidized bed reaction. B is an illustrative alcohol derived from a SASOL reaction.

SASOL alcohols may be marketed as "Ethylol" or "Propanol Plus", typical compositions containing the components, in parts by weight set forth in columns C and D respectively of the following table. Column E sets forth illustrative commercial mixtures which may be available. Column F sets forth the nominal (i.e. as stated on the label) content of a commercially available mixture of 80 w % Ethylol plus 20 w % Propanol Plus, Column G sets forth an actual analysis of the material bearing the label stated in column F.

| Component | C | D | E | F | G |
|---|---|---|---|---|---|
| Ethanol | 90 | | 60–85 | 72.2 | 78.7 |
| isopropanol | 10 | | 5–15 | 8 | 4.7 |
| n-propanol | | 45 | 5–15 | 9 | 6.9 |
| C-4 alcohols | | 29 | 3–9 | 5.8 | 4.9 |
| C-5 alcohols | | 16.5 | 1–5 | 3.2 | 3.4 |
| C-6 alcohols | | 9 | 0.5–0.3 | 1.8 | 1.7 |
| C-7 alcohols | | | | | 0.1 |

These mixtures of oxy-alcohols (also called oxo-alcohol) are found to be poor extenders for middle distillates including diesel fuels in the presence of water. Their solubility is so low that a two-phase mixture is formed if 3 w %–8 w % be added in the presence of water in amounts of 0.05 w % or more. For example, addition to a diesel fuel of 5 w % anhydrous alcohol yields a two phase mixture in the presence of 0.1 w % water at 70° F.

In accordance with certain aspects of the invention, it is possible to solubilize these mixtures of predominently lower alcohols, typically C-2 to C-6 lower alkyl alcohols, by converting them to lower alkyl ethers. The typical lower t-alkyl ethers may be C-4 or C-5 ethers eg the t-butyl ether or the t-amyl ether of the alcohols in the mixture.

In the preferred mode of operation, this may be effected by reacting the alcohol composition with an isobutylene—or isoamylene-containing (or mixtures thereof) hydrocarbon stream—to form the t-butyl ethers and/or the t-amyl ethers of the alcohols.

The iso-olefin stream may be a pure isobutene stream, a pure isoamylene stream, a mixed stream, a B—B stream exiting a FCC unit etc. A typical B—B stream may contain the following:

| B—B STREAM | |
|---|---|
| Component | Parts by weight |
| Propane | 7.8 |
| propene | 1.2 |
| Isobutane | 34.7 |
| n-Butane | 12.6 |
| Cis and trans 2-Butene | 17.3 |

-continued

| B—B STREAM | |
|---|---|
| Component | Parts by weight |
| 1-Butene | 8.9 |
| Isobutene | 11.7 |
| C-5 and heavier | 6.1 |

Etherification may be carried out using the following reaction conditions:

TABLE

| Condition | Broad | Preferred | Typical |
|---|---|---|---|
| Temperature (°F.) | 100–300 | 150–250 | 200 |
| Pressure (psig) | 50–750 | 50–500 | 300 |
| Isoalkene (parts) | 5–50 | 15–40 | 25 |
| Alcohol (parts) | 20–90 | 15–40 | 25 |
| Ratio isoalkene: alcohol | 1 | 1.2–4 | 2 |
| LHSV | 0.5–5 | 1–3 | 2 |

Etherification may be preferably carried out in the presence of a solid resin etherification catalyst. These catalysts are preferably relatively high molecular weight carbonaceous materials containing at least one —$SO_3H$ group as the functional group. Typical of these catalysts are the sulfonated coals ("Zeo-KarbH", "Nalcite X" and "Nalcite AX") produced by the treatment of bituminous coals with sulfuric acid. These materials are usually available in a neutralized form and in this case must be activated to the hydrogen form by treatment with a strong mineral acid such as hydrochloric acid, followed by water washing to remove sodium and chloride ions prior to use.

The sulfonated resin type catalysts are preferred for use in the present invention. These catalysts include the reaction products of phenolformaldehyde resins and sulfuric acid ("Amberlite IR-1", "Amberlite IR-100", and "Nalcite MX"). Also useful are the sulfonated resinous polymers of coumarone-indene with cyclopentadiene; sulfonated polymers of coumarone-indene with furfural, sulfonated polymers of coumarone-indene with cyclopentadie and furfural; and sulfonated polymers of cyclopentadiene with furfural.

The most preferred cationic exchange resins are strongly acidic exchange resins consisting essentially of sulfonated polystyrene resin, for instance, a divinylbenzene cross-linked polystyrene matrix having 0.5–20% and preferably 4–16% of copolymerized divinylbenzene therein, bearing ionizable or functional nuclear sulfonic acid groups. These resins are manufactured and sold commercially under various trade names such as "Dowex 50", "Nalcite HCR" and "Amberlyst 15". As commercially obtained they have a solvent content of about 50% and can be used as is or the solvent can be removed first. The resin particle size may typically be 10 to 50 mesh (United States Sieve Series).

The reaction may be carried out in either a stirred slurry reactor or in a fixed bed continuous flow reactor. The catalyst concentration should be sufficient to provide the desired catalytic effect. Generally catalyst concentration should be 0.5–50% (dry basis) by weight of the reactor contents, preferably 1–25%.

During the reaction there are formed the tertiary-butyl ether and/or the tertiary amyl ether of the ethanol, the normal propanol, the normal butanol, and the normal pentanol. The isopropyl alcohol and the secondary and tertiary C-4 and C-5 alcohols do not react to any significant degree.

An illustrative ether-containing product, that prepared from the 80 w % Ethylol—20 w % Propanol-Plus alcohol charge, may contain the following:

| Component | Broad | Typical |
|---|---|---|
| Ethyl, t-butyl ether | 65–91 | 79.8 |
| isopropyl alcohol | 2.5–6 | 4 |
| n-propyl, t-butyl ether | 6–9 | 8.6 |
| C-4 alcohol plus C-4 t-butyl ether | 4.5–8.5 | 5 |
| C-5 alcohol plus C-5 t-butyl ether | 2–4 | 2.5 |
| C-6 alcohols | 0.05–2 | 0.1 |

The ether-alcohol mixtures so prepared may be used to extend gasoline and middle distillates such as diesel fuels. The ether-alcohol mixtures may be added to fuels in amount of 0.5–40 or more parts per 100 parts of fuel. The mixture may typically be added to 100 parts by weight of gasoline in amount of 0.5–15, say 10 parts by weight. The mixture may be typically added to 100 parts by weight of diesel fuel in amount of 2–4 parts, preferably 1–20 say 10 parts by weight.

In the case of gasolines, the product is found to be characterized by the following advantages:

(i) the alcohols present in the ether-alcohol mixture extend the gasoline;

(ii) the ethers serve to extend the gasoline and to increase the octane number;

(iii) the resultant gasoline is characterized by a desirably higher flash point due to the presence inter alia of the heavier molecular weight components;

(iv) the resultant gasoline has a higher water tolerance than is the case if equivalent amounts of ether or alcohol be added.

In the case of a typical diesel fuel, the product is found to possess the following advantages:

(i) the alcohols present in the ether-alcohol mixture extend the diesel oil;

(ii) the ethers serve to extend the diesel oil and to increase the cetane number when compared to addition of the unreacted alcohols.

It will be particularly apparent that the mixture of secondary and tertiary C-3 to C-5 alcohols plus t-butyl (or t-amyl) ethers of C-2 to C-5 alcohols permits attainment of advantages not realized if either the alcohols or the ethers were used alone. Among these may be noted the fact that the small quantities of C-3 to C-5 alcohols present in the mixture will serve to keep the fuel dry by solubilizing small quantities of water that may be present. If large quantities of water contaminate the fuel, these alcohols will tend to partition into the fuel rather than into the water phase (unlike ethanol or methanol). The conversion of ethanol to its ether will remove the possibility of formation at a two-phase system in the presence of small amounts of water.

There may be typically added to 100 parts of gasoline 0.5–15 parts, say 10 parts of ether-alcohol mixture to effect the following changes:

| Property | Base Gasoline | +Alcohol Alone | +Ether-Alcohol |
|---|---|---|---|
| ibp | 90 | | |
| ep | 420 | | |
| RON | 90 | 92 | 93 |
| MON | 81 | 82 | 83.1 |

-continued

| Property | Base Gasoline | +Alcohol Alone | +Ether-Alcohol |
|---|---|---|---|
| Water-tolerance | — | poor | excellent |
| API | 60 | | |

There may typically be added to 100 parts of diesel oil 2–40 parts, say 10 parts of ether-alcohol mixture to effect the following change:

| Property | Base Fuel | +Alcohol alone | +Ether-Alcohol |
|---|---|---|---|
| cetane number | 45 | 37 | 43 |
| water-tolerance | | poor | excellent |

In the case of both the gasoline and the diesel oil, it will be apparent that the use of the ether-alcohol mixture permits attainment of desirable results which are not obtained if equal amounts of alcohol are added.

Practice of the process of this invention will be apparent to those skilled in the art from the following wherein, as elsewhere in this specification, all parts are parts by weight unless otherwise specified.

DESCRIPTION OF THE PREFERRED EMBODIMENTS

EXAMPLE I

In this example, a SASOL alcohol, containing 80 w % "Ethylol" and 20 w % "Propanol Plus" is charged containing the following:

| w % | Component |
|---|---|
| 78.7 | ethanol |
| 4.7 | isopropyl alcohol |
| 6.9 | n-propanol |
| 4.9 | C-4 alcohols (primarily isobutanol) |
| 3.4 | C-5 alcohols |
| 1.7 | C-6 alcohols |

This mixture is reacted with isobutylene (1.1 mole olefin:1 mole alcohol) at 200° F., 100 psig, and 2 LHSV over Amberlyst 15 brand of hydrogen form of divinylbenzene-crosslinked, sulfonated polystyrene solid resin etherification catalyst.

Product ether-alcohol liquid contains:

| w % | Component |
|---|---|
| 79.8 | ethyl, t-butyl ether |
| 4 | isopropyl alcohol |
| 8.6 | n-propyl, t-butyl ether |
| 5 | C-4 alcohol, C-4, t-butyl ether |
| 2.5 | C-5 alcohol, C-5, t-butyl ether |
| 0.1 | C-6 alcohols |

10 parts of this ether-alcohol product mixture are mixed with 100 parts of gasoline. The properties of the gasoline, before and after mixing are as follows:

| Property | Gasoline | Gasoline + Mixture |
|---|---|---|
| ibp °F. | 90 | 90 |

-continued

| Property | Gasoline | Gasoline + Mixture |
|---|---|---|
| ep °F. | 420 | 420 |
| RON (clear) | 90 | 93 |
| MON | 81 | 83.1 |
| Water Tolerance | — | Excellent |
| API | 60 | 60 |

From the above, it will be apparent that:

(i) the octane number is increased;

(ii) the gasoline is extended:

(iii) Gasoline plus Sasol alcohols gave phase separation in the presence of 0.25 w % water. Gasoline plus mixture does not give phase separation in the presence of this amount of water.

EXAMPLE II

In this example, 10 parts of the ether-alcohol product of Example I is added to 100 parts of a diesel oil. The following is noted:

| Property | Diesel Oil | Diesel Oil + Mixture |
|---|---|---|
| Cetane number | 45 | 43 |
| Water Tolerance | Poor | Excellent |

From the above, it will be apparent that:

(i) addition of the ether-alcohol mixture extends the diesel oil;

(ii) the water tolerance is desirably increased;

(iii) the cetane number is maintained reasonably constant.

Results comparable to Example II may be attained if the ether-alcohol mixture is added to the following:

| Example | Hydrocarbon |
|---|---|
| III | Furnace Oil |
| IV | Kerosene |
| V | Straight Run Gas Oil |

The products of the examples are all single phase, extended mixtures characterized by improved properties including improved water tolerance.

Although this invention has been illustrated by reference to specific embodiments, it will be apparent to those skilled in the art that various changes and modifications may be made which clearly fall within the scope of this invention.

We claim:

1. The method of extending a hydrocarbon fuel which comprises mixing (i) a liquid hydrocarbon fuel and (ii) an ether-alcohol mixture formed by etherifying an oxo-alcohol mixture with a C-4 or C-5 iso-olefin, thereby forming a single phase extended liquid hydrocarbon fuel characterized by improved water tolerance; and recovering said single phase extended liquid hydrocarbon fuel characterized by improved water tolerance.

2. The method of extending a liquid hydrocarbon fuel as claimed in claim 1 wherein said fuel is a gasoline.

3. The method of extending a liquid hydrocarbon fuel as claimed in claim 1 wherein said fuel is a hydrocarbon fuel heavier than gasoline.

4. The method of extending a liquid hydrocarbon fuel as claimed in claim 1 wherein said fuel is a diesel fuel.

5. The method of extending a liquid hydrocarbon fuel as claimed in claim 1 wherein said ether-alcohol mixture is present in amount of 0.5–40 parts per 100 parts of hydrocarbon fuel.

6. The method of extending a liquid hydrocarbon fuel as claimed in claim 1 wherein said oxo-alcohol mixture is a Fischer-Tropsch oxo-alcohol mixture.

7. The method of extending a liquid hydrocarbon fuel as claimed in claim 1 wherein said oxo-alcohol mixture is a SASOL oxo-alcohol mixture.

8. A novel single phase, extended liquid hydrocarbon fuel composition characterized by improved water tolerance which comprises (i) a liquid hydrocarbon fuel and (ii) an ether-alcohol mixture formed by etherifying an oxo-alcohol mixture with a C-4 or C-5 olefin.

9. A novel single phase, extended liquid hydrocarbon fuel composition as claimed in claim 8 wherein said hydrocarbon fuel is gasoline.

10. A novel single phase, extended liquid hydrocarbon fuel composition as claimed in claim 8 wherein said hydrocarbon fuel is a hydrocarbon fuel heavier than gasoline.

11. A novel single phase, extended liquid hydrocarbon fuel composition as claimed in claim 8 wherein said hydrocarbon fuel is a diesel fuel.

12. The method of extending a hydrocarbon fuel heavier than gasoline which comprises mixing (i) 100 parts of a liquid hydrocarbon fuel heavier than gasoline and (ii) 0.5–40 parts of an ether-alcohol mixture formed by etherifying an oxo-alcohol mixture with at least one olefin selected from the group consisting of C-4 and C-5 iso-olefins, thereby forming a single phase extended liquid hydrocarbon fuel heavier than gasoline, characterized by improved water tolerance; and recovering said single phase extended liquid hydrocarbon fuel heavier than gasoline characterized by improved water tolerance.

13. The method of extending a hydrocarbon fuel heavier than gasoline as claimed in claim 12 wherein said fuel is a diesel fuel.

14. A novel single phase, extended liquid hydrocarbon fuel composition characterized by improved water tolerance which comprises (i) 100 parts of a liquid hydrocarbon fuel heavier than gasoline and (ii) 0.5–40 parts of an ether-alcohol mixture formed by etherifying an oxo-alcohol mixture with at least one iso-olefin selected from the group consisting of C-4 and C-5 isoolefins.

15. A novel single phase, extended liquid hydrocarbon fuel composition as claimed in claim 14 wherein said liquid hydrocarbon fuel is a diesel fuel.

* * * * *

UNITED STATES PATENT AND TRADEMARK OFFICE

CERTIFICATE OF CORRECTION

PATENT NO. : 4,356,001

DATED : October 26, 1982

INVENTOR(S) : William M. Sweeney & Sheldon Herbstman

It is certified that error appears in the above—identified patent and that said Letters Patent is hereby corrected as shown below:

column 3, line 45, cancel "the", insert --this--;

column 4, line 42, cancel "cyclopentadie, insert --cyclopentadiene--;

claim 8, line 5, cancel "olefin", insert --iso-olefin--.

Signed and Sealed this

*Seventeenth* Day of *May 1983*

[SEAL]

*Attest:*

DONALD J. QUIGG

*Attesting Officer*

*Acting Commissioner of Patents and Trademarks*